US010460889B2

(12) United States Patent
Lee

(10) Patent No.: US 10,460,889 B2
(45) Date of Patent: Oct. 29, 2019

(54) LOCKOUT DEVICE

(71) Applicant: Wallace Keith Lee, Canton, MS (US)

(72) Inventor: Wallace Keith Lee, Canton, MS (US)

( * ) Notice: Subject to any disclaimer, the term of this patent is extended or adjusted under 35 U.S.C. 154(b) by 0 days.

(21) Appl. No.: 15/134,376

(22) Filed: Apr. 20, 2016

(65) Prior Publication Data

US 2017/0309415 A1 Oct. 26, 2017

(51) Int. Cl.
*H01H 9/28* (2006.01)

(52) U.S. Cl.
CPC ..... *H01H 9/282* (2013.01)

(58) Field of Classification Search
CPC ..... H01H 9/20; E05B 65/00
USPC ..... 200/43.01, 43.11, 43.13–43.16, 334, 200/43.19, 43.21
See application file for complete search history.

(56) References Cited

U.S. PATENT DOCUMENTS 5,419,165 A 5/1995 Perkins
5,451,730 A * 9/1995 Phillips, Sr. ..... H01H 31/006 200/330
5,772,007 A * 6/1998 Frye ..... H01H 9/282 200/43.14
6,727,441 B2 4/2004 Benda
6,829,914 B2 12/2004 Bullock
2004/0251116 A1 12/2004 Cruz
2007/0033971 A1 2/2007 Nasin
2008/0302146 A1 12/2008 Cannon

* cited by examiner

*Primary Examiner* — Edwin A. Leon
*Assistant Examiner* — Lheiren Mae A Caroc
(74) *Attorney, Agent, or Firm* — William C West

(57) ABSTRACT

A lockout device is presented to maintain an on/off switch lever of a disconnect box in a preferred position. A grasp portion of the lockout device that is in an unlocked position may be inserted in the on/off switch lever of the disconnect outlet box preventing the on/off switch lever from being moved from an off position to an on position, or vise versa. Once the grasp hook is inserted in the on/off switch lever, the lockout device can be moved to a locked position and secured with one or more padlocks to prevent the lockout device from being removed. A middle portion of the lockout device may be made of varying lengths to allow easy access to on/off switch levers of disconnect boxes located overhead, below the user's feet or in confined spaces without the requirement for ladders or other special access equipment.

20 Claims, 9 Drawing Sheets

LOCKOUT DEVICE

CROSS-REFERENCE TO RELATED APPLICATIONS

Not applicable.

FEDERALLY SPONSORED RESEARCH

Not applicable.

BACKGROUND

Field of Invention

The lockout device of the present invention relates in general to electrical shut-off means typically associated with industrial machinery and which allows an individual to easily shut off and turn on an electrical current to the machine for safety purposes during servicing or repairs. However, the present lockout device more particularly pertains to a device that can be easily used to access the on/off switch associated with an overhead electrical switch box. The lockout device is of simple construction and may be made from insulated components so as to eliminate any possibility of accidental electrical shock. The lockout device when in the off mode insures that the on/off switch cannot be accidentally moved into the on position, and when in the on mode insures that the on/off switch remains in operating position. A first hook or a second hook of the lockout device may be used to pull down on a top edge of an on/off switch lever to move the lever to the "off" position, and the grasp portion of the first hook may be used to push up on a bottom edge of the on/off switch lever moving the on/off switch lever to the "on" position. When the on/off switch lever is moved to the "off" position, a lever lock point, a through opening, of the on/off switch lever is aligned with a stub lock point, a second through opening, of the off stub. A business end 13 of the grasp portion may be placed through the lever lock point and the stub lock point, and then the second unit of the lockout device moved to a locked state with a tip of the second unit moving into a groove 17*a* of the grasp portion 16. The lockout device may be secured with one or more padlocks placed through lock points 30*a* of the first unit and alternate lock point of the first unit to prevent the lockout device from being removed without access to the keys of the one or more padlocks. The lockout device may be of varying lengths to allow easy access to the on/off switch of the disconnect outlet box when: the disconnect outlet box is elevated without a ladder or elevated platform; the disconnect outlet box is at an elevation lower than the user, or the disconnect outlet box is in a confined space, such as in, behind, or on machinery, such as a trash compactor hydraulic system disconnect outlet box.

BACKGROUND OF THE INVENTION

Switches are used in many applications to control the flow of electrical energy. The switches can be used to redirect or stop the flow of electrical energy through a circuit. Many of these circuit breakers include a lever which is movable between an "On" position and an "Off" position.

Manufacturing facilities often have circuit breakers that cut the flow of electrical current through a circuit at elevated and hard to reach locations, often requiring ladders, raised platform, or other specialized equipment to access the circuit breakers. To save time and quickly lockout the circuit, it is desirable to have a lockout means that is simple, easy to employ, and minimizes the need for special access equipment.

There are lock out devices that engage breaker levers to prevent unauthorized movement of the levers. However, many lock out devices do not adequately serves to provide notice to an individual that movement of the lever is unauthorized, or the capability to access and lock out the circuit breaker lever from extended distances.

It is therefore contended that a need exists for a new and improved type of lockout device having a extended middle portion acting as an extended arm that may be used for disconnecting overhead electrical switches and which eliminates the inherent drawbacks and disadvantages of the known prior art. It is further contended that such a lockout device should be durable, safe, easy to use and inexpensive to manufacture.

SUMMARY OF THE INVENTION

It is therefore a primary object of the present invention to provide an electrical lockout device with an extended middle portion that allows the user to easily shut off an on/off switch of an electrical disconnect box located overhead, below the user's feet, or in confined space, without the need for ladders, scaffolding, or special lift devices.

It is yet another object of the present invention to provide a lockout device that may be easily installed and assembled on site without the need for any specialized skills or tools.

It is a further object of the present invention is to provide a lockout device that does not require any modifications of either the disconnect box or the machinery associated therewith, and may normally be maintained in the open position using a spring biased locking unit that prevents the locking device from moving to the locked position accidentally, a situation likely to happen when employing the device to a disconnect box located below the user's feet.

A still further object of the present invention is to provide a lockout device that once installed can be removed and used again when needed. This is important when there is a need to temporarily shut off the power and then turn on the power by removing the lockout device.

Yet another object of the present invention is to provide a lockout device that is protected with insulated materials, reducing the likelihood of electrocution.

Another important object of the present invention is to provide an lockout device that can be secured by one or more security devices, such as a padlock, giving the user the option of employing the device where access to change the state requires a buddy team or two or more people with each person having a key to one of the padlocks.

Still a further object of the present invention is to provide a lockout device that may be sold and produced as a kit having all the necessary components for installation and instructions for assembly included therewith.

BRIEF DESCRIPTION OF THE DRAWINGS

The detailed description of the present invention together with the accompanying drawings serve to explain the principles of the invention and are incorporated in and form part of the specification with a brief description of the drawings as follows.

DETAILED DESCRIPTION OF PREFERRED EMBODIMENTS

Figure 1B:
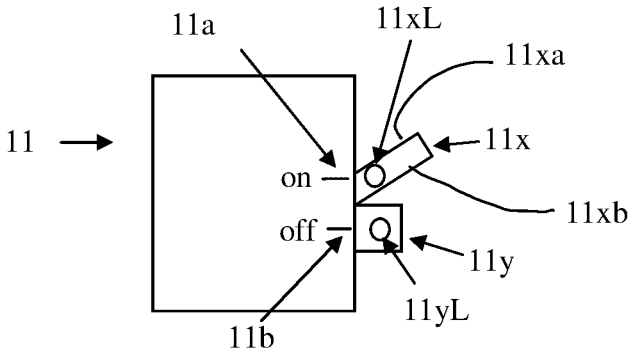
FIG. 1B is a view of an electrical disconnect box.
Figure 1A:
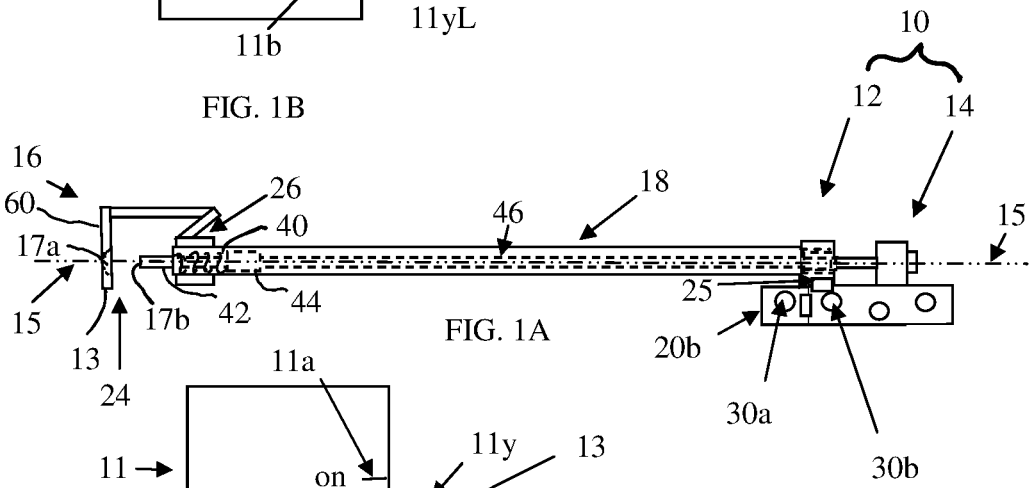
FIG. 1A is a side view for the present invention in an unlocked position.
Figure 1C:
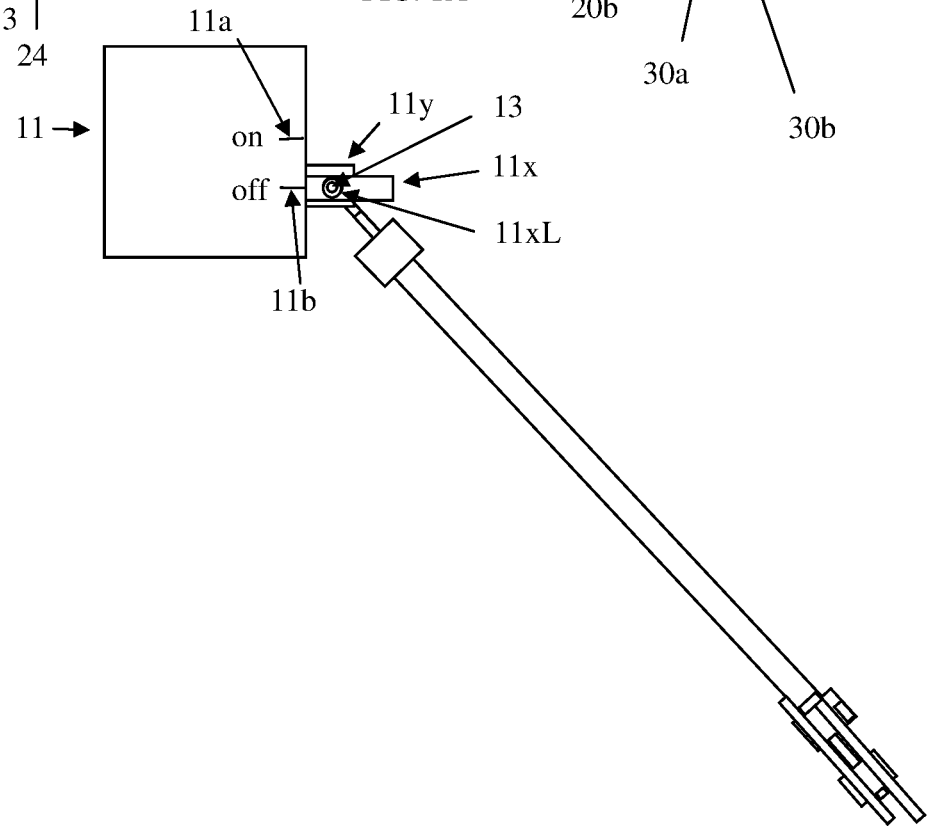
FIG. 1C is a view of the lockout device on the electrical disconnect box.
Figure 2A:
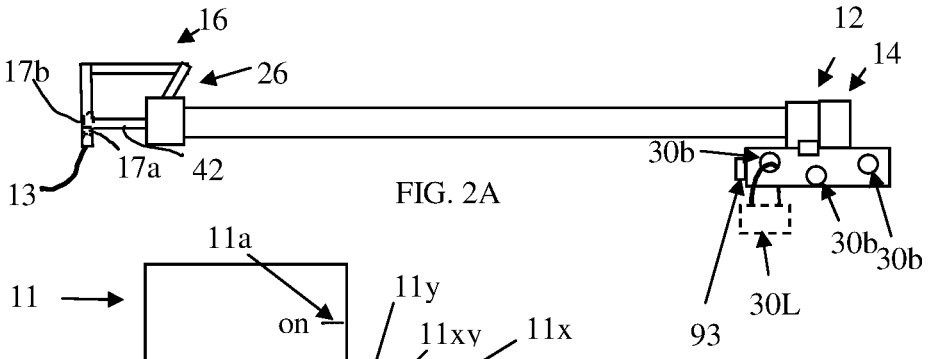
FIG. 2A is a side view for the present invention in a locked position.
Figure 2B:
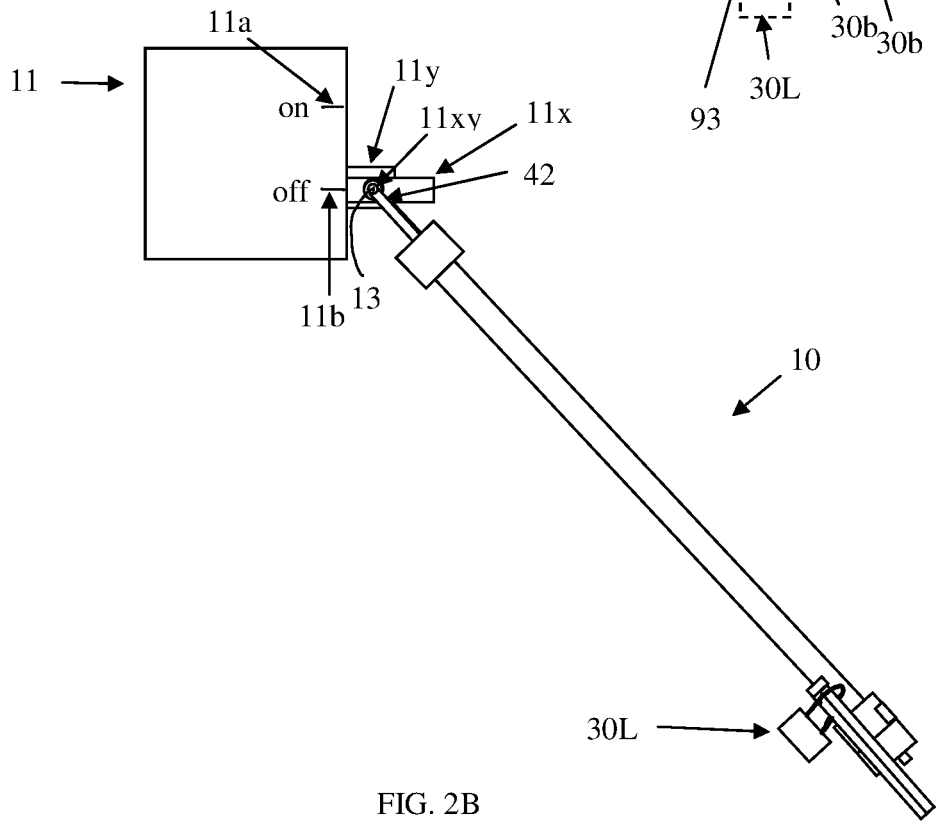
FIG. 2B is a view for the present invention on an electrical disconnect box.

Looking to FIG. 1A, in one embodiment of the present invention, a lockout device 10, is presented in an unlocked position below an electrical disconnect box 11 shown in FIG. 1B having an on position 11*a*, an off position 11*b*, an on/off switch lever 11*x* with a lever lock point 11*x*L, and an off stub 11*y* with a stub lock point 11*y*L. The on/off switch lever 11*x* may be moved from the on position 11*a* to the off position 11*b* to shut power off and back to the on position 11*a* to once again energize an electrical circuit. The lockout device 10 comprises a first unit 12 with a business end 13, and a second unit 14 generally aligned along a longitudinal axis 15. The first unit 12 has a hook portion 16 that may have a groove 17*a* designed for a tip 17*b* of the second unit 14. The business end 13 of the first unit 12 of the lockout device 10 may be placed through the lever lock point 11*x*L of the on/off switch lever 11*x* when it is aligned with the stub lock point 11*y*L of the off stub 11*y* to prevent the on/off switch lever 11*x* from moving to the on position 11*a* as shown in FIG. 1C. FIG. 2A shows the lockout device 10 moved to the locked position with the tip 17*b* of the second unit 14 in the groove 17*a*. Looking to FIG. 2B, this prevents the business end 13 from slipping out of the lever lock point 11*x*L when the on/off switch lever 11*x* is aligned with the off stub 11*y*.

Figure 3:
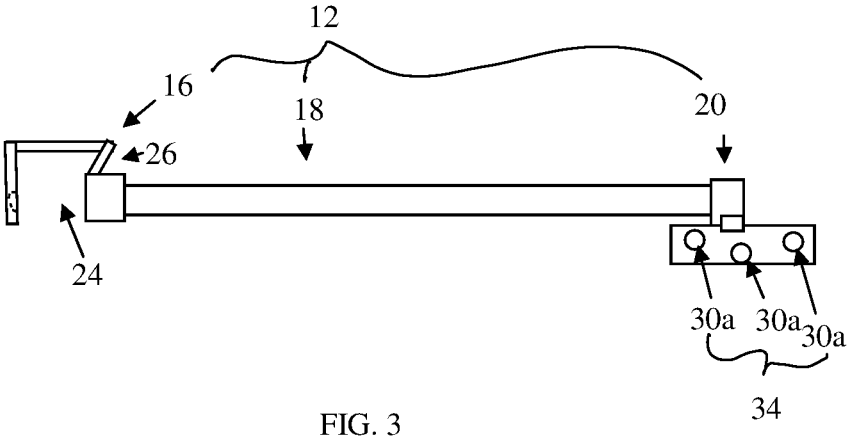
FIG. 3 is a side view of a first unit of the present invention.
Figure 4:
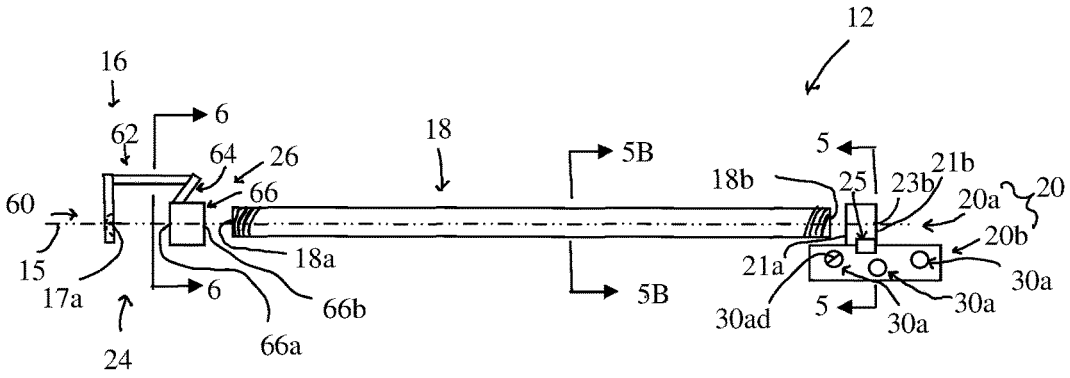
FIG. 4 is a side view of a disassembled first unit of the present invention.
Figure 5:
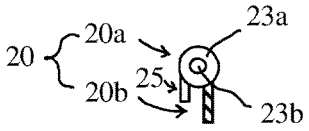
FIG. 5 is a sectional view along line 5-5 of FIG. 4.
Figure 6:
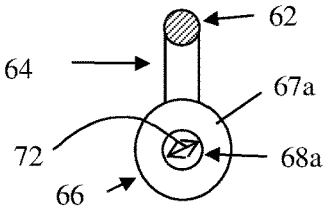
FIG. 6 is a sectional view along line 6-6 of FIG. 4.

Looking to FIG. 3, the first unit 12 comprises a hook portion 16, a middle portion 18, and a lock portion 20, the middle portion 18 located between the hook portion 16 and the lock portion 20. The hook portion 16 has at least a first hook 24. Another embodiment may have the first hook and a second hook 26 with the first hook 24 formed opposite the second hook 26. Looking to FIG. 4, the lock portion 20 has one or more lock points 30*a*. The lock point 30*a* that may be a circular aperture with a lock diameter 30*ad* between ¼ and 1 inches, but may be sized for a particular or other security device. The lock portion 20 has a lock cap 20*a* and a lock plate 20*b*. The lock cap 20*a* may be generally cylindrical and hollow. The lock cap 20*a* has a middle portion end 21*a* and an alignment end 21*b*. Looking to FIGS. 4 and 5, the alignment end 21*b* has an alignment face 23*a* with a lock aperture 23*b*; the lock aperture 23*b* centered on the longitudinal axis 15 of FIG. 1A. Looking again to FIGS. 4 and 5, a slide guide 25 that may be a rectangular plate may extend from the lock cap 20*a*. The slide guide 25 is positioned to allow the second unit 14 shown in FIG. 1A to slide between the slide guide 25 and the lock plate 20*b* of the first unit 12 shown in FIG. 5. The slide guide 25 may be welded to the lock cap 20*a*. Looking to FIG. 4, the lock cap 20*a* may be internally threaded from the middle portion end 21*a* toward the alignment end 21*b*. A second treaded end 18*b* of the middle portion 18 is inserted in the middle portion end 21*a* of the lock cap 20*a*. FIG. 6 provides a sectional view of the hook portion 16 along line 6-6 of FIG. 4 that will be discussed later.

Figure 7:
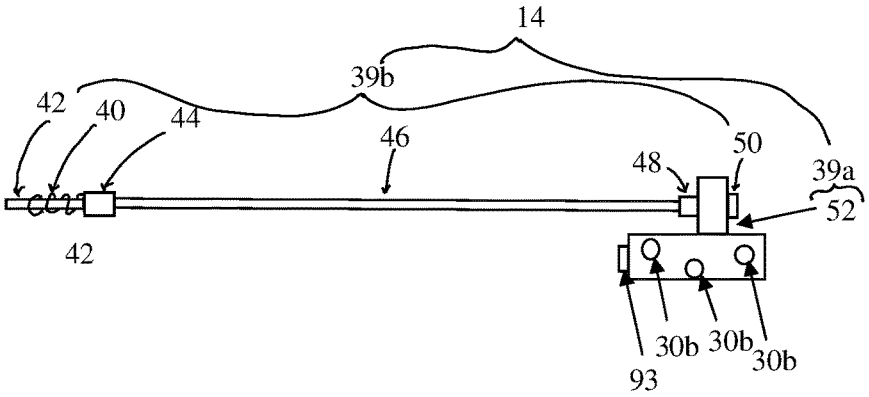
FIG. 7 is a side view of a second unit of the present invention.
Figure 8:
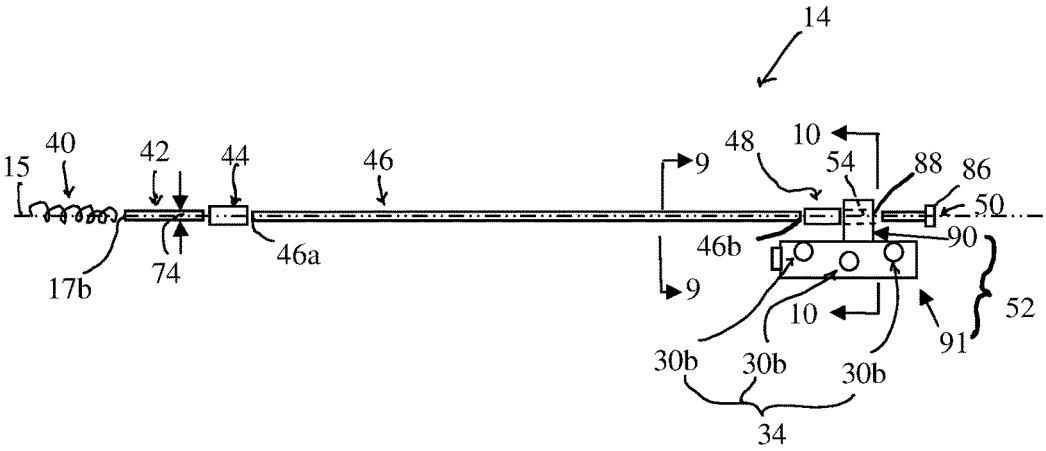
FIG. 8 is a side view of the disassembled second unit of the present invention.

Looking to FIG. 7, the second unit 14 comprises a support means 39*a* and a locking means 39*b*, the locking means 39*b* comprising a spring 40, a forward element 42, a spring hold 44, a slide element 46, a second hold 48, and a rear element 50. The support means 39*a* comprises an alignment element 52 having one or more alternate lock points 30*b*. The one or more alternate lock points 30*b* are configured to align with the one more lock points 30*a* of the first unit shown in FIGS. 1 and 3, placing the lockout device 10 in the locked position as shown in FIG. 2A. A padlock 30L can be placed through the one or more alternate lock points 30*b* when aligned with the one more lock points 30*a* of FIG. 1A to provide further security. Looking to FIG. 8, the alignment element 52 has an alignment aperture 54. Looking again to FIG. 4, the middle portion 18 of the first unit 12 is generally parallel with the slide element 46 of the second unit 14 shown in FIG. 7. Looking at FIG. 1A, in an unlocked position, the one or more lock points 30*a* are offset from the one or more alternate lock points 30*b* of the second unit 14. Looking again to FIGS. 7 and 8, the second hold 48 connects the slide element 46 to the rear element 50 and secures looking means 39*b* in the support means 39*b*. The spring hold 44 connects the forward element 42 to the slide element 46 and is configured to hold the spring 40 between the hook portion 16 of FIG. 1A and the spring hold 44 of FIG. 8. The spring 40 is decompressed when the lockout device 10 is in the unlocked position as shown in FIG. 1A preventing the forward element 42 from accidentally moving to the locked position, and compressed in the locked position of FIG. 2A. Looking again to FIG. 8, the spring hold 44 and the second hold 48 may be a hollow and internally threaded and are open ended. They forward element 42 and the slide element 46 may be connected to the spring hold 44 by threads or by welds (not shown), a glue (not shown), or by other mechanical means, such as a pin (not shown). Likewise the second hold 48 may be connected to the slide element 46 and the rear element 50.

Figure 9:
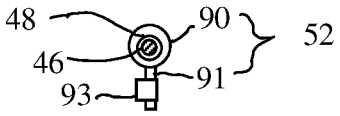
FIG. 9 is a sectional view along line 9-9 of FIG. 8.
Figure 10:
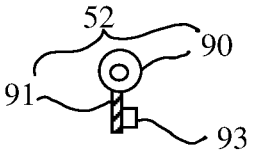
FIG. 10 is a sectional view along line 10-10 of FIG. 8.

Looking again to FIGS. 4 and 6, the hook portion 16 further comprises a grasp portion 60, a connect portion 62, a slant portion 64 and a hook cap portion 66. The connect portion 62 is located between the slant portion 64 and the grasp portion 60; the slant portion 64 is located between the hook cap portion 66 and the connect portion 62. The connect portion 62 may be generally perpendicular to the grasp portion 60 with the grasp portion 60, the connect portion 62, the slant portion 64, and the hook cap portion 66 forming the first hook 24. The slant portion 64 may extend from the hook cap portion 66 and generally away from the grasp portion 60 and away from the middle portion 18 of the first unit 12 and toward the connect portion 62. The hook cap portion 66 and the slant portion 64 may form the second hook 26. The grasp portion 60 may have the groove 17*a* sized for the tip 17*b* of the forward element 42, shown in FIG. 8. FIG. 9 is a sectional view along line 9-9 of FIG. 8 looking back along the slide element 46 toward the alignment element 52. FIG. 10 is a sectional view along line 10-10 of FIG. 8 looking along the longitudinal axis 15 toward the alignment element 52. Looking again at FIGS. 1A and 3, The first hook 24 or the second hook 26 of the lockout device 10 may be used to pull down on a top edge 11*xa* of the on/off switch lever 11*x* to move the on/off switch lever 11*x* to the "off" position 11*b*, and the grasp portion 60 of the first hook 24 of the hook portion 16 may be used to push up on a bottom edge 11*xb* of the on/off switch lever 11*x* to move the on/off switch lever 11*x* to the "on" position 11*a*.

Figure 11:
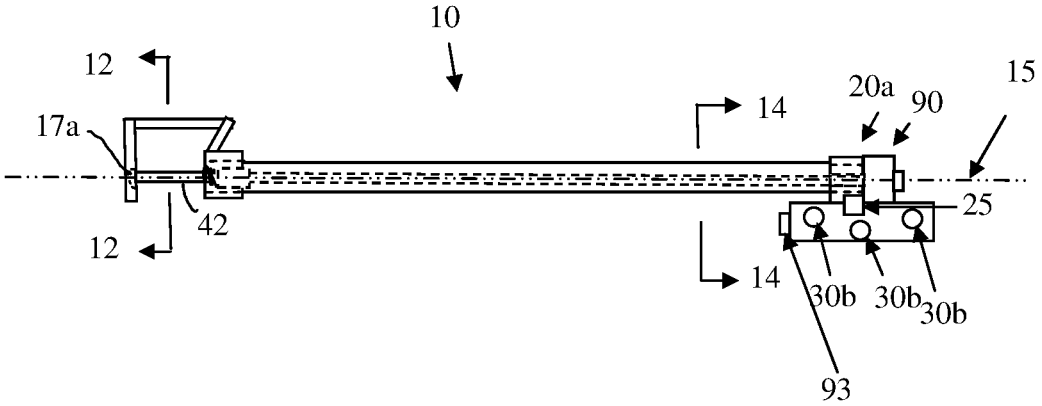
FIG. 11 is another side view of the present invention in the locked position.
Figure 12:
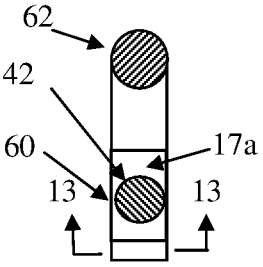
FIG. 12 is a sectional view along line 12-12 of FIG. 11.
Figure 13:
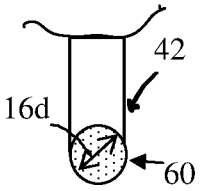
FIG. 13 is a sectional view along line 13-13 of FIG. 11.
Figure 14:
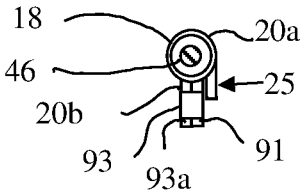
FIG. 14 is a sectional view along line 14-14 of FIG. 11.

Looking along the sectional line 12-12 of FIG. 11, when the lockout device 10 is in the locked position, the forward element 42 is inserted into the groove 17*a*. Looking along the sectional line 13-13 of FIG. 12, the grasp portion 60 may have a circular cross section with a hook diameter 16*d* that may be between ⅜ to ¼ inches and the grasp portion 60 may be made of hardened steel. Also, the connect portion 62, and the slant portion 64 of FIG. 4 may be generally a circular rods having the same hook diameter 16*d* and made of the same material. The grasp portion 60, the connect portion 62, the slant portion 64 and the hook cap portion 66 may be connected using welds, or the grasp portion 60, the connect portion 62, and the slant portion 64 and the hook cap portion 66 may be manufactured as a one piece unit. Looking at FIG. 14, a sectional line 14-14 of FIG. 11, a clip 93 of the alignment plate 91 will clip the lock plate 20*b* and hold the lock plate 20*b* to the alignment plate 91. The clip 93 is configured to curve over a clip edge 93*a* of the lock plate 20 with the clip 93 holding the alignment plate 91 adjacent to the lock plate 20*b* when the lockout device 10 is locked. The slide guide 25 is generally somewhat greater than a width of the alignment plate 91 plus the clip 93 from the lock plate 20*b*. When the lockout device 10 is unlocked the clip 93 does not cover the clip edge 93*a*.

Figure 15:
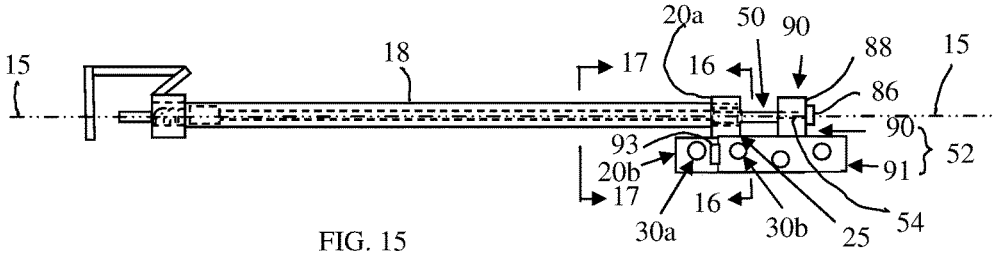
FIG. 15 is a side view of the present invention in the unlocked position.
Figure 16:
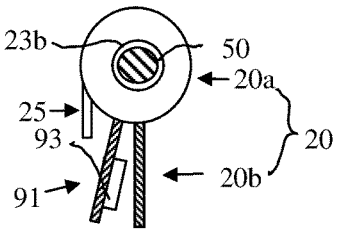
FIG. 16 is a sectional view along line 16-16 of FIG. 15.
Figure 17:
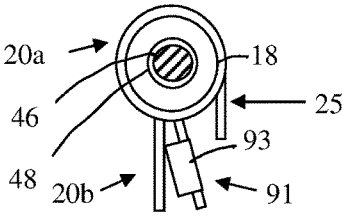
FIG. 17 is a sectional view along line 17-17 of FIG. 15.

Looking again to FIG. 6 the hook cap portion 66 has a hook cap aperture 68*a* with a hook cap diameter 72. The hook cap diameter 72 is somewhat larger an element diameter 74 of the forward element 42 shown in FIG. 8. The forward element 42, the slide element 46, and the rear element 50 may have the same element diameter 74 as measured traverse to the longitudinal axis 15. The forward element 42, the slide element 46, and the rear element 50 run along the longitudinal axis 15 of the lockout device 10. The forward element 42 runs through the hook cap aperture 68*a* shown in FIG. 6. Looking to FIG. 15, the rear element 50 is inserted through a alignment aperture 54 of the rotating portion 90 of the alignment element 52 and then, looking to FIG. 16, through the lock aperture 23*b* of the lock portion 20 so that, looking to FIG. 15, a head 86 of the rear element 50 is adjacent to a back face 88 of a rotating portion 90 of the alignment element 52. The rotating portion 90 of the alignment element 52 is located between the head 86 of the rear element 50 and the lock cap 20*a*. The alignment element 52 has the rotating portion 90 and an alignment plate 91. The alignment plate 91 has the clip 93 with the clip 93 configured to hold the alignment plate 91 to the lock plate 20*b* when the lockout device 10 is in the locked position shown on FIG. 2A. FIG. 17 is a sectional view of the middle portion 18 of the lockout device 10 of FIG. 15 looking toward the lock cap 20*a* and the lock plate 20*b*.

Figure 18A:
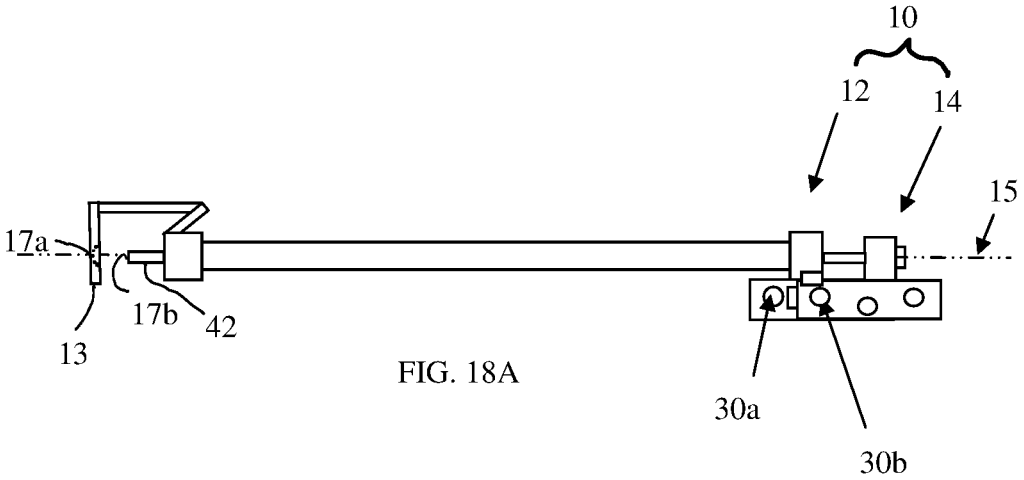
FIG. 18A is another side view of the one embodiment of the present invention.
Figure 18B:
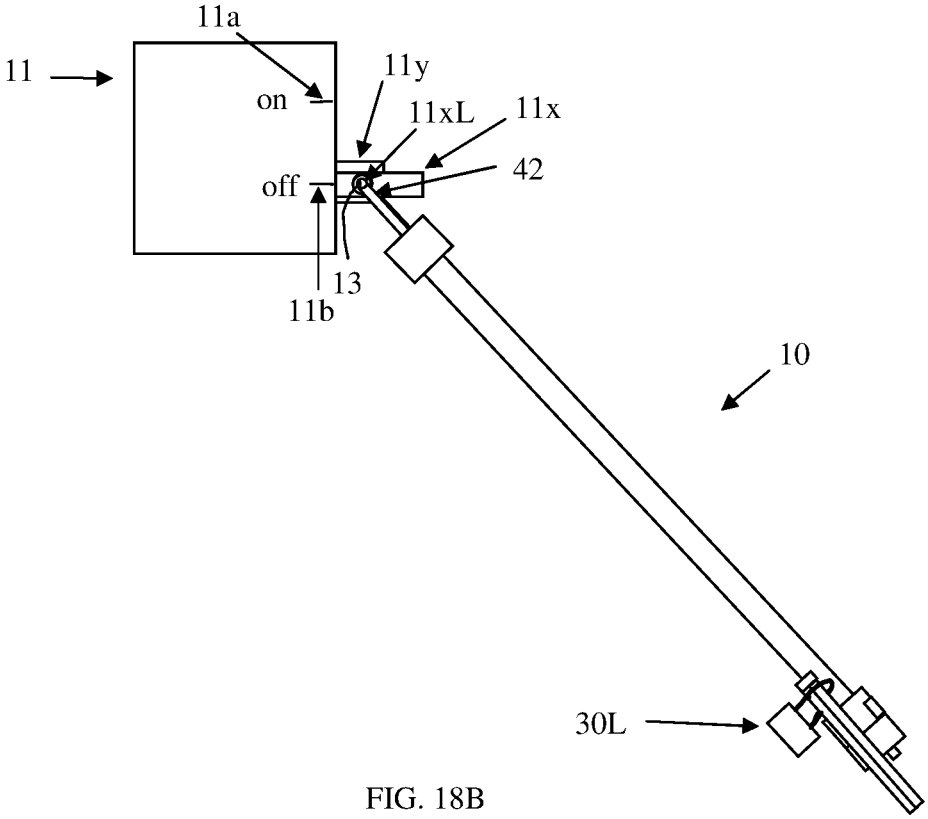
FIG. 18B is another view of the one embodiment on the electrical distribution box.

Looking again to FIG. 4 and FIG. 6, the hook cap portion 66 has a hook end 66*a* and a cap end 66*b*. The hook cap portion 66 is generally a hollow cylinder with a hook cap face 67*a* on the hook end 66*a* and open at the cap end 66*b*; the hook end 66*a* having the hook cap aperture 68*a* in the hook cap face 67*a*; the hook cap aperture 68*a* centered on the longitudinal axis 15 of the lockout device 10. The hook cap portion 66 may be internally threaded from the cap end 66*b* toward the hook end 66*a*. The first threaded end 18*a* of the middle portion 18 is inserted in the cap end 66*b*, and a second threaded end 18*b* of the middle portion, being externally threaded, inserted in the middle portion end 21*a* the lock cap 20*a* of the lock portion 20. FIG. 18A is another side view of the lockout device 10 in the unlocked position above the disconnect box 11 shown in FIG. 18B, and a second view of the lockout device 10 in the locked positioned employed on the disconnect box 11. Looking to FIG. 1A, the middle portion 18 and the slide element 46 of the lockout device may be made of one or more electrically nonconductive materials, such as a nonconductive plastic, a rubber coated material, or other nonconductive materials, to prevent electrocution of the user of the lockout device.

Although a version of the present invention have been described in considerable detail with reference to the version thereof, other versions are possible. Therefore, the spirit and scope of the appended claims should not be limited to the description of the preferred version contained herein. Various deviations and modification may be made within the spirit and scope of this invention without departing from the main theme thereof.

What is claimed is:

1. A lockout device comprising a first unit and a second unit; the first unit comprising a hook portion, a middle portion, and a lock portion; said middle portion located between and directly connected to the hook portion and the lock portion; and the second unit comprising a support means and a locking means; the support means connected to the locking means; the locking means disposed substantially parallel to the middle portion of the first unit; a forward element of the locking means being substantially linear; and the locking means closing with the hook portion placing the lockout device in a locked position by holding together a lever lock point of an on/off switch lever and a stub lock point of an off stub of an electrical disconnect box.

2. The lockout device according to claim 1 wherein the second unit moves relative to the first unit locking and unlocking the lockout device; a business end of the first unit placed through the lever lock point of an on/off switch lever and through the stub lock point of an off stub of the electrical disconnect box when the lever lock point and the stub lock point are aligned; and a tip of a distal end of the locking means closing with the hook portion placing the lockout device in a locked position holding the on/off switch lever in an off position.

3. The lockout device according to claim 2 wherein the lock portion comprises a lock cap and a lock plate.

4. The lockout device according to claim 3 wherein the lock plate further comprises one or more lock points.

5. The lockout device according to claim 4 wherein the lock cap comprises a middle portion end and an alignment end; the alignment end having an alignment face with a lock aperture; the lock aperture centered on a longitudinal axis; the lock cap having a slide guide; and the middle portion inserted in the middle portion end of the lock cap.

6. The lockout device according to claim 1 wherein the hook portion comprises at least a first hook.

7. The lockout device according to claim 6 wherein the hook portion is shaped so that a second hook is formed from a slant portion and a hook cap portion; the second hook opening opposite the first hook.

8. The lockout device according to claim 1 wherein the support means comprises an alignment element; the alignment element further comprising a rotating portion and an alignment plate; the alignment plate having one or more alternate lock points; and the one or more alternate lock points aligning with one or more lock points of the lock portion when the lockout device is locked.

9. The lockout device according to claim 1 wherein the locking means comprises a spring, the forward element, a spring hold, a slide element, a second hold, and a rear element; the spring located around the forward element; the spring hold located between and connecting the forward element and the slide element; the second hold located between and connecting the rear element and the slide element; the spring, the forward element, the spring hold, the slide element, the second hold, and the rear element aligned on the longitudinal axis of the lockout device; and the rotating portion of the support means configured to rotate around the rear element; and the rotating portion located between a head of the rear element and the lock portion.

10. The lockout device according to claim 9 wherein the middle portion and the slide element are made of one or more electrically nonconductive materials.

11. A lockout device comprising a first unit and a second unit; the first unit comprising a hook portion, a middle portion, and a lock portion; said middle portion located between and directly connected to the hook portion and the lock portion; and the second unit comprising a support means and a locking means; the support means connected to the locking means; a forward element of the locking means being substantially linear: the locking means having a tip; the tip configured to move substantially parallel to a longitudinal axis of the lockout device; and the tip disposed adjacent to the hook portion when the lockout device is in a locked position by holding together a lever lock point of an on/off switch lever and a stub lock point of an off stub of an electrical disconnect box; and the tip being a distal end of the locking means of the second unit.

12. The lockout device according to claim 11 wherein the lock portion comprises a lock cap and a lock plate;

the lock portion having one or more lock points;

the lock cap having a middle portion end and an alignment end; the alignment end having an alignment face with a lock aperture; the lock aperture centered on the longitudinal axis;

the lock cap having a slide guide; and the middle portion connected to the middle portion end of the lock cap.

13. The lockout device according to claim 11 wherein the hook portion comprises at least a first hook.

14. The lockout device according to claim 13 wherein a second hook is formed from a slant portion and a hook cap portion of the hook portion; and the second hook opening opposite the first hook.

15. The lockout device according to claim 11 wherein the support means comprises an alignment element; the alignment element having one or more alternate lock points.

16. The lockout device according to claim 15 wherein the locking means comprises a spring, the forward element, a spring hold, a slide element, a second hold, and a rear element;

said one or more alternate lock points disposed overlaying and aligned with the one or more lock points when the lockout device is locked;

said alignment element having an alignment aperture;

the middle portion of the first unit substantially parallel with the slide element of the second unit;

the one or more lock points of the lock portion overlaying and aligned with the one or more alternate lock points of the alignment element of the second unit when the lockout device is locked;

the one or more lock points of the lock portion being not aligned with the one or more alternate lock points of the alignment element when the lockout device is unlocked;

the second hold connecting the slide element to the rear element;

the spring hold connecting the forward element to the slide element.

17. The lockout device according to claim 16 wherein the hook portion comprises a grasp portion, a connect portion, a slant portion and a hook cap portion; said connect portion between the slant portion and the grasp portion; the slant portion located between the hook cap portion and the connect portion; the connect portion substantially perpendicular to the grasp portion; the grasp portion, the connect portion, the slant portion, and the hook cap portion forming the first hook;

the slant portion extending from the hook cap portion and away from the grasp portion and away from the middle portion of the first unit and toward the connect portion; the hook cap portion and the slant portion forming a second hook; the grasp portion having a groove sized for the tip of the forward element;

the hook cap portion having a hook cap aperture with a hook cap diameter somewhat larger than an element diameter of the forward element;

the forward element, the slide element, and the rear element having the element diameter as measured traverse to the longitudinal axis of the lockout device; the forward element, the slide element, and the rear element running parallel to the longitudinal axis of the lockout device;

the forward element running through the hook cap aperture; the hook cap portion biasing the spring;

the spring running around the forward element and located between the hook cap aperture of the hook cap portion and the spring hold;

the spring compressed when the lockout device is locked and decompressed when the lockout device is unlocked;

the rear element running through the alignment aperture of a rotating portion of the alignment element and then through the lock aperture of the lock portion so that a head of the rear element is adjacent to a back face of the rotating portion of the alignment element;

the rotating portion of said alignment element located between the head of the rear element and the lock portion; the alignment element having the rotating portion and an alignment plate; and the alignment plate having a clip and the one or more alternate lock points.

18. The lockout device according to claim 17 wherein the hook cap portion has a hook end and a cap end; said hook cap portion being hollow with a hook cap face on the hook end and open at the cap end; said hook end having the hook cap aperture in the hook cap face; the hook cap aperture centered on the longitudinal axis of the lockout device; the hook cap portion internally threaded from the cap end toward the hook end; and a first threaded end of the middle portion inserted in the cap end.

19. The lockout device according to claim 11 wherein the hook portion comprises a grasp portion, a connect portion, a slant portion and a hook cap portion; said connect portion between and connected to the slant portion and the grasp portion; the slant portion located between and connected to the hook cap portion and the connect portion; the grasp portion, the connect portion, the slant portion, and the hook cap portion forming the first hook; the slant portion extending from the hook cap portion and angled away from the hook cap portion and away from the middle portion of the first unit and toward the connect portion; the hook cap portion and the slant portion forming a second hook; the second hook opening between hook cap portion and were the slant portion joins the connect portion; the first hook formed across the slant portion from the second hook.

20. A lockout device comprising a first unit and a second unit; the first unit comprising a hook portion, a middle portion, and a lock portion; said middle portion located between the hook portion and the lock portion; and the second unit comprising a support means and a locking means; the lock portion comprising a lock cap and a lock plate; the lock portion having one or more lock points; the lock cap having a middle portion end and an alignment end; the alignment end having an alignment face with a lock aperture; the lock aperture centered on the longitudinal axis; the lock cap being internally threaded from the middle portion end toward the alignment end; the lock cap having a slide guide; and a second treaded end of the middle portion inserted in the middle portion end of the lock cap.

* * * * *